US012428778B2

(12) United States Patent
Fujimoto et al.

(10) Patent No.: US 12,428,778 B2
(45) Date of Patent: Sep. 30, 2025

(54) CARBON FIBER BUNDLE WITH ADHERED SIZING AGENT

(71) Applicant: TEIJIN LIMITED, Osaka (JP)

(72) Inventors: Taisuke Fujimoto, Osaka (JP); Akimichi Oda, Osaka (JP); Hidekazu Yoshikawa, Osaka (JP)

(73) Assignee: TEIJIN LIMITED, Osaka (JP)

( * ) Notice: Subject to any disclaimer, the term of this patent is extended or adjusted under 35 U.S.C. 154(b) by 473 days.

(21) Appl. No.: 18/014,443

(22) PCT Filed: Jul. 2, 2021

(86) PCT No.: PCT/JP2021/025136
§ 371 (c)(1),
(2) Date: Jan. 4, 2023

(87) PCT Pub. No.: WO2022/009796
PCT Pub. Date: Jan. 13, 2022

(65) Prior Publication Data

US 2023/0272577 A1 Aug. 31, 2023

(30) Foreign Application Priority Data

Jul. 7, 2020 (JP) ..... 2020-116962

(51) Int. Cl.
*D06M 15/55* (2006.01)
*D06M 15/507* (2006.01)
*D06M 15/53* (2006.01)
*D06M 101/40* (2006.01)

(52) U.S. Cl.
CPC ..... *D06M 15/55* (2013.01); *D06M 15/507* (2013.01); *D06M 15/53* (2013.01); *D06M 2101/40* (2013.01); *D06M 2200/40* (2013.01)

(58) Field of Classification Search
CPC ..... D06M 15/55
See application file for complete search history.

(56) References Cited

U.S. PATENT DOCUMENTS

2007/0269363 A1* 11/2007 Murai ..... D06M 13/17 428/367
2012/0276383 A1* 11/2012 Hirano ..... C08G 18/6674 428/368
2014/0329075 A1 11/2014 Ichikawa et al.
2015/0184333 A1 7/2015 Arai et al.
2015/0252184 A1 9/2015 Arai et al.
2016/0009881 A1 1/2016 Fujita et al.
2019/0256672 A1* 8/2019 Bowland ..... C08K 7/06
2021/0309820 A1 10/2021 Kaneta et al.

FOREIGN PATENT DOCUMENTS

| | | | | |
|---|---|---|---|---|
| CN | 104011288 | A | 8/2014 | |
| CN | 104508022 | A | 4/2015 | |
| CN | 104684975 | A | 6/2015 | |
| CN | 107916572 | A | 4/2018 | |
| EP | 2 886 590 | A1 | 6/2015 | |
| JP | 2004-238761 | A | 8/2004 | |
| JP | 2005-179826 | A | 7/2005 | |
| JP | 2008-274520 | A | 11/2008 | |
| JP | 2012-214925 | A | 11/2012 | |
| JP | 5582269 | B1 | 9/2014 | |
| JP | 2015-10290 | A | 1/2015 | |
| JP | 2016-089276 | A | 5/2016 | |
| JP | 2016-160567 | A | 9/2016 | |
| JP | 6495423 | B1 | 4/2019 | |
| JP | 2020-002518 | A | 1/2020 | |
| KR | 20170089474 | A * | 8/2017 | ..... D06B 3/02 |
| WO | 2005/075554 | A1 | 8/2005 | |
| WO | 2018/079763 | A1 | 5/2018 | |
| WO | 2020/138139 | A1 | 7/2020 | |

OTHER PUBLICATIONS

International Preliminary Report on Patentability dated Jan. 10, 2023 with a Translation of the Written Opinion of the International Searching Authority in Application No. PCT/JP2021/025136.
"Test Report", CERI (Chemicals Evaluation and Research Institute, Japan), Sep. 6, 2022, pp. 1-3 (3 total pages).
European Search Report issued Jan. 17, 2024 in European Application No. 21838186.1.
Office Action/Search Report dated Apr. 30, 2024, issued in Chinese Patent Application No. 202180048328.9.
International Search Report for PCT/JP2021/025136 dated Aug. 17, 2021 [PCT/ISA/210].

* cited by examiner

*Primary Examiner* — Andrew T Piziali
(74) *Attorney, Agent, or Firm* — Sughrue Mion, PLLC

(57) ABSTRACT

A carbon fiber bundle having a high abrasion resistance property and simultaneously being excellent in widening property is provided by a carbon fiber bundle with an adhered sizing agent including a carbon fiber bundle, and a sizing agent adhered to a surface of the carbon fiber bundle, wherein the sizing agent contains an epoxy compound, and shows an intersection of a storage modulus and a loss modulus at an angular frequency in the range of $1\times10^5$ to $1\times10^9$ rad/sec in a measurement at 25° C.

12 Claims, No Drawings

CARBON FIBER BUNDLE WITH ADHERED SIZING AGENT

CROSS REFERENCE TO RELATED APPLICATIONS

This application is a National Stage of International Application No. PCT/JP2021/025136 filed Jul. 2, 2021, claiming priority based on Japanese Patent Application No. 2020-116962 filed Jul. 7, 2020.

TECHNICAL FIELD

The present invention relates to a carbon fiber bundle with an adhered sizing agent.

BACKGROUND ART

Carbon fibers are excellent in specific strength and specific modulus and are lightweight, and thus are used as composite materials by combining with thermosetting resins and thermoplastic resins, and are utilized in the fields of sports, general industries, aviation and space, automobiles, etc.

In general, carbon fibers are formed into a bundle and handled as a carbon fiber bundle. A sizing agent is added to a carbon fiber bundle for the purpose of improving the handling property in processing the carbon fiber into a composite material and the physical properties of the obtained composite material.

Aromatic epoxy resins have been conventionally used as sizing agents (for example, Patent Literature 1). These sizing agents improve the tight adhesiveness between a carbon fiber bundle and a matrix resin when these are formed into a composite material, and improve the abrasion property (abrasion resistance) and handling property, but are still insufficient.

On the other hand, aliphatic epoxy resins are suggested as sizing agents for improving the tight adhesiveness between a carbon fiber bundle and a matrix resin (Patent Literature 2). However, the abrasion characteristic is poor in the cases where these aliphatic epoxy resins are used. Originally, carbon fiber bundles are widening and used in many cases so as to impregnate a matrix resin in a carbon fiber bundle, but a sufficient widening property cannot be obtained by aliphatic epoxy resins.

PTL 1: JP-A-2012-214925

PTL 2: JP-A-2005-179826

DISCLOSURE OF INVENTION

Technical Problem

The present invention aims at providing a carbon fiber bundle having a high abrasion and simultaneously being excellent in widening property.

Solution to Problem

The present invention is a carbon fiber bundle with an adhered sizing agent including:

a carbon fiber bundle, and a sizing agent adhered to a surface of the carbon fiber bundle, wherein the sizing agent contains an epoxy compound, and shows an intersection of a storage modulus and a loss modulus at an angular frequency in the range of $1\times10^5$ to $1\times10^9$ rad/sec in a measurement at 25° C.

Advantageous Effects of Invention

According to the present invention, a carbon fiber bundle having a high abrasion property and simultaneously being excellent in widening property can be provided.

BEST MODE FOR CARRYING OUT THE INVENTION

The present invention will be explained below in detail.

[Carbon Fiber Bundle]

As the carbon fiber for constituting the carbon fiber bundle in the present invention, for example, pitch-based carbon fibers, rayon-based carbon fibers, acrylonitrile (PAN)-based carbon fibers, single layer carbon nanotubes, multilayer carbon nanotubes, and carbon nanofibers can be used. From the viewpoints of workability, step passability and mechanical strength, acrylonitrile (PAN)-based carbon fibers are preferably used. Incidentally, the fineness and strength properties of the carbon fiber are optional.

The carbon fiber bundle is a bundle of carbon fiber filaments (single yarns). The number of the carbon fiber filaments constituting the carbon fiber bundle is preferably 10 or more, further preferably 100 or more, further preferably 1,000 to 100,000. The number of the carbon fiber filaments constituting the carbon fiber bundle is preferably 3,000 to 80,000, especially preferably 6,000 to 50,000 from the viewpoint of producibility. In the present invention, by using the carbon fiber bundle having this filament number, excellent step processability can be obtained during processing. When the number of the carbon fiber filament constituting the carbon fiber bundle is less than 10, although there is a tendency that the flexibility of the carbon fiber bundle increases and the handling property is improved, it is not preferable since the producibility of the carbon fiber bundle tends to decrease. On the other hand, when the number exceeds 100,000, it is not preferable since the production of the carbon fiber bundle may become difficult, and a treatment with a surface treatment agent tends to be insufficient. Furthermore, the carbon fiber bundle is preferably a continuous fiber from the viewpoint of producibility.

The shape of the carbon fiber bundle is preferably a planular shape. The ellipticity of the carbon fiber bundle (the width/thickness of the carbon fiber bundle) is preferably 10 times or more, especially preferably 50 to 400 times. When the ellipticity is within this range, it is preferable since the sizing agent and a matrix resin are easy to permeate into the fiber bundle and easy to diffuse.

The time necessary for impregnating the center part of the carbon fiber bundle with the sizing agent and the matrix resin is proportional to a square of a thickness of the carbon fiber bundle. Therefore, in order to complete the impregnation within a short time, it is preferable that the carbon fiber bundle has a wide width and a thin thickness. From this viewpoint, the thickness of the carbon fiber bundle is preferably 200 μm or less. On the other hand, from the viewpoints of handling property and moldability, the thickness of the carbon fiber bundle is preferably 10 μm or more. The thickness of the carbon fiber bundle is further preferably 30 to 150 μm, especially preferably 50 to 120 μm.

The width of the carbon fiber bundle is preferably 5 mm or more, especially preferably 10 to 100 mm from the viewpoint of the impregnation property of a resin when the resin and the carbon fiber bundle are formed into a composite for manufacturing a prepreg.

The average diameter of the carbon fiber filaments constituting the carbon fiber bundle is preferably 0.001 to 100 μm, further preferably 3 to 20 μm, further preferably 4 to 15 μm, especially preferably 5 to 10 μm. When the average diameter of the carbon fiber filaments is smaller than this, it is not preferable since the carbon fiber bundle becomes bulky, and thus it tends to be difficult to increase the volume fraction of the carbon fiber bundle in the obtained composite material. On the other hand, when the average diameter of the carbon fiber filaments is greater than this, it is not preferable since there is a tendency that it is difficult to obtain a high strength. By setting the average diameter of the carbon fiber filaments to be within the above-mentioned range, an excellent mechanical strength can be obtained in a composite material using the carbon fiber bundle.

[Sizing Agent]

It is integral that the sizing agent in the present invention is a sizing agent that shows an intersection of a storage modulus and a loss modulus at an angular frequency in the range of $1\times10^5$ to $1\times10^9$ rad/sec in a measurement at 25° C.

A sizing agent that shows the above-mentioned intersection at a position at an angular frequency less than $1\times10^5$, a sufficient opening property cannot be obtained in widening the carbon fiber bundle by abrasion with a metal bar, etc. On the other hand, in a sizing agent that shows the above-mentioned intersection at a position greater than $1\times10^9$ rad/sec, the convergence propriety property of the carbon fiber bundle is insufficient, and the handling property is deteriorated. The position of the above-mentioned intersection in the sizing agent used in the present invention is preferably in the range of $1\times10^5$ to $1\times10^8$ rad/sec, further preferably in the range of $1\times10^6$ to $1\times10^7$ rad/sec.

It is preferable that this sizing agent has Tan δ at 25° C. of 1 or more in an entire range of an angular frequency of 1 to $1\times10^5$ rad/sec. When this condition is satisfied, the convergence propriety property of the carbon fiber bundle is increased, and a carbon fiber bundle having an excellent handling property can be formed.

The sizing agent in the present invention contains an epoxy compound. As this epoxy compound, for example, aromatic epoxy compounds and aliphatic epoxy compounds can be used.

In the case where the epoxy compound of the sizing agent is an aromatic epoxy compound, an aromatic epoxy compound having a molecular weight of 300 or more is preferable. By using this aromatic epoxy compound, the convergence propriety property by the sizing agent can be improved, and the adhesiveness between the matrix resin and the surface of the carbon fiber can be improved. The upper limit of the molecular weight of the epoxy compound is, for example, 10,000, preferably 5,000.

As this aromatic epoxy compound, bisphenol A-type epoxy compounds, bisphenol F-type epoxy compounds, biphenyl-type epoxy compounds, naphthalene-type epoxy compounds, phenol novolac-type epoxy compounds, cresol novolac-type epoxy compounds, and trisphenolmethane-type epoxy compounds can be exemplified.

Among these aromatic epoxy compounds, those being a liquid at 25° C. are preferably used. By using an aromatic epoxy compound being a liquid at 25° C., a homogeneous interface can be formed on the carbon fiber of the carbon fiber bundle, and by homogeneously covering the entirety of the carbon fiber of the carbon fiber bundle, a carbon fiber bundle having excellent abrasion resistance can be formed.

Incidentally, in the case where an aromatic epoxy compound being a solid at 25° C. is used, it is preferable to use an epoxy compound that can solve the aromatic epoxy compound in combination. As this epoxy compound, an aliphatic epoxy compound being a liquid at 25° C. or an aromatic epoxy compound being a liquid at 25° C. can be used.

In the case where the epoxy compound in the sizing agent is an aliphatic epoxy compound, an aliphatic epoxy compound being a liquid at 25° C. is preferable. By using the aliphatic epoxy compound being a liquid at 25° C., a homogeneous interface is formed on the carbon fiber of the carbon fiber bundle and the entirety of the carbon fiber of the carbon fiber bundle is homogeneously covered, and thus a carbon fiber bundle having an excellent abrasion resistance can be obtained.

Among the aliphatic epoxy compounds, an aliphatic epoxy compound having a polyalkylene glycol backbone having one or more hydrocarbon group on the side chains is preferable. In the case where this is used, the abrasion resistance of the obtained carbon fiber bundle with an adhered sizing agent is significantly improved.

As the aliphatic epoxy compound having a polyalkylene glycol backbone having one or more hydrocarbon group on the side chains, trimethylolpropane polyglycidyl ether, propylene glycol diglycidyl ether, polypropylene glycol diglycidyl ether, neopentyl glycol diglycidyl ether, and 2-ethylhexylglycidyl ether can be exemplified. Among these, an aliphatic epoxy compound having a propylene oxide backbone is especially preferable. As this compound, propylene glycol diglycidyl ether, and polypropylene glycol diglycidyl ether can be exemplified.

As the aliphatic epoxy compound having a polyalkylene glycol backbone having one or more hydrocarbon group on the side chains, an aliphatic epoxy compound having a water solubility rate when 10 parts by weight of the aliphatic epoxy compound is added to 90 parts by weight of water of 30% by weight or less is preferable. By using the aliphatic epoxy compound having a water solubility rate of 30% by weight or less, the hydrolysis of the epoxy groups during a storage period is suppressed, and a sizing agent having an excellent long-term stability can be obtained.

The sizing agent can further contain a thermoplastic resin besides the above-mentioned epoxy compound. As this thermoplastic resin, a thermoplastic resin having a complex viscosity at 25° C. 1 Hz of 100 Pa·s or more is preferably used. By using this thermoplastic resin, it becomes easy to adjust the intersection of a storage modulus and a loss modulus at 25° C. to be within a predetermined range.

This thermoplastic resin is further preferably a thermoplastic resin having a storage modulus at 25° C. 1 Hz of 1,000 Pa or more. When this thermoplastic resin is used, it becomes easy to adjust the intersection of a storage modulus and a loss modulus to be within a predetermined range, and consequently, a carbon fiber bundle that can achieve a balance between a convergence propriety property and widening property can be obtained.

As the above-mentioned thermoplastic resin, thermoplastic polyesters, polyamides, polyurethanes, and polyvinyl alcohols can be exemplified. Among these, a polyester having a molecular weight of 1,000 to 10,000 is preferable. By incorporating this, the abrasion resistance of the carbon fiber bundle can be improved. When the molecular weight is less than 1,000, it is not preferable since a favorable scratch property of the carbon fiber bundle cannot be obtained. A further preferable molecular weight of this thermoplastic polyester is 1,000 to 5,000. By using the thermoplastic polyester having this molecular weight, a carbon fiber bundle having an excellent widening property can be obtained.

As the above-mentioned thermoplastic resin, among thermoplastic polyesters, a polyester polyol is preferably used. This polyester polyol has a molecular weight of preferably 1,000 to 10,000. By using the polyester polyol having this molecular weight, a carbon fiber bundle having an especially excellent widening property can be obtained.

[Adhesion of Sizing Agent]

As a method for adhering the sizing agent to the carbon fiber bundle, a method including preparing a sizing solution, which is a solution containing a sizing agent, and adhering the sizing solution to the carbon fiber (a sizing treatment) is preferably used. The solvent or dispersion medium used for the sizing solution is preferably water. That is, an aqueous dispersion of the sizing agent is preferably used as the sizing solution.

[Emulsifier]

In order to prepare the aqueous dispersion of the sizing agent, for example, an anion-based, cation-based or nonionic surfactant can be used as an emulsifier. From the viewpoints of the emulsification performance and the stability of the aqueous dispersion, the nonionic surfactant is preferably used.

As the nonionic surfactant, polyethylene glycol types (such as higher alcohol ethylene oxide adducts, alkylphenol ethylene oxide adducts, aliphatic acid ethylene oxide adducts, polypropylene glycolethylene oxide adducts, etc.), and polyvalent alcohol types (aliphatic acid esters of glycerin, sorbitol aliphatic acid esters, aliphatic acid alkanolamides, etc.) can be exemplified. Among these, polyoxyalkylene-based compounds are preferable. By using the above-mentioned emulsifiers, the friction resistance between the surface of the carbon fiber and a metal can be decreased, and consequently, a carbon fiber bundle having an excellent abrasion property can be obtained. Among the above-mentioned polyoxyalkylene-based compounds, polyoxyethylene polyoxypropylene block polymers are preferable. By using a polyoxyethylene polyoxypropylene block polymer as an emulsifier, the friction resistance between the surface of the carbon fiber and a metal can be decreased by the effect of the hydrocarbon groups of the polyoxyethylene units, and consequently, a carbon fiber bundle having a further excellent abrasion property can be obtained.

The content of the nonionic surfactant in the sizing agent is preferably 1 to 50% by weight, further preferably 10 to 40% by weight, especially preferably 20 to 40% by weight per 100% by weight of a total weight of the epoxy compound and the nonionic surfactant. In the case where a polyoxyalkylene-based compound is used as the nonionic surfactant, the content of the polyoxyalkylene-based compound in the sizing agent is preferably 1 to 50% by weight, further preferably 10 to 40% by weight, especially preferably 20 to 40% by weight per 100% by weight of a total weight of the epoxy compound and the polyoxyalkylene-based compound. If the content is less than 1% by weight, it is not preferable since an effect for improving abrasion resistance is difficult to obtain. On the other hand, if the content is greater than 50% by weight, it is not preferable since the amount of the epoxy groups in the sizing agent may be decreased, and the adhesiveness between the carbon fiber bundle and the matrix resin may be decreased.

As the method for emulsification, a method using a batch equipped with stirring blades, a method using a ball mill, a method using a shaker, and a method using a high-shear emulsifier such as a Gaulin homogenizer can be exemplified.

As a method for sizing a carbon fiber bundle, methods in which a carbon fiber bundle is brought into contact with a sizing solution can be exemplified. Specifically, a touch-roll type in which part of a roll is immersed in a sizing solution to transfer the sizing solution to a surface of the roll, and a carbon fiber bundle is then brought into contact with this roll to adhere the sizing solution to the carbon fiber bundle, and an immersion type in which a carbon fiber bundle is directly immersed in a sizing solution, and then passed through nip rolls as necessary to control the amount of the adhered sizing solution can be exemplified.

As a method for removing the solvent or the dispersion medium of the sizing solution from the carbon fiber bundle, a heat treatment, air dry, and centrifugation can be exemplified. These may also be used in combination. From the viewpoint of costs, a heat treatment is preferable. As a heating means in the heat treatment, for example, hot air, a hot plate, a roller, and an infrared heater can be used.

[Manufacture Method]

Hereinafter the method for manufacturing a carbon fiber bundle with an adhered sizing agent of the present invention will be explained with exemplifying a case where a carbon fiber bundle of a PAN-based carbon fiber is used.

<Precursor Fiber>

As a precursor fiber of the carbon fiber, an acrylic precursor fiber is preferably used. This acrylic precursor fiber is an acrylic precursor fiber containing acrylonitrile by preferably 90 mass % or more, further preferably 95 mass % or more, and containing other monomers by preferably 10 mass % or less, further preferably 5 mass % or less. This is an acrylic precursor fiber manufactured by spinning a spinning solution. As the other monomers used for the polymerization, itaconic acid, and (meth)acrylic acid esters can be exemplified.

A precursor fiber can be obtained by subjecting the raw material fiber obtained by the spinning to washing with water, drying, drawing and an oiling treatment. The number of filaments constituting the precursor fiber is preferably 1,000 or more, further preferably 12,000 or more, especially preferably 24,000 or more from the viewpoint of manufacture efficiency.

<Oxidation Treatment>

A Oxidation treatment is carried out by heating a fiber bundle of the obtained precursor fiber in heating air at 200 to 300° C. for 10 to 100 minutes. In the Oxidation treatment, it is preferable to subject the fiber bundle of the precursor fiber to a drawing processing, and the draw ratio is preferably 0.90 to 1.20 times.

<Carbonization Treatment>

A carbon fiber bundle can be obtained by carbonizing the oxidized fiber bundle of the precursor fiber at 300 to 2,000° C. In order to obtain a carbon fiber bundle having a dense inner structure having a higher tensile strength, it is preferable to carry out a carbonization treatment undergoing two steps of carbonization steps: subjecting the fiber bundle of the precursor fiber to low temperature carbonization at 300° C. to 1,000° C., and further subjecting to high temperature carbonization at 1,000 to 2,000° C. In the case where a higher modulus is to be obtained, a graphite treatment may further be carried out at a high temperature of 2,000 to 3,000° C.

<Surface Oxidation Treatment>

It is preferable to carry out a surface treatment on the carbon fiber bundle obtained above so as to improve the wettability with the sizing agent and the resin to be a matrix. The surface treatment can be carried out by a conventionally known method. The surface treatment is generally carried out by electrolytic oxidation since the apparatus used is convenient and the control in the steps is easy. Electrolytic oxidation is also preferable in the present invention.

An electric quantity to be applied to the surface treatment by electrolytic oxidation is preferably set to 10 to 150 coulomb with respect to 1 g of the carbon fiber bundle. By adjusting the electric quantity to be within this range, a carbon fiber bundle having excellent dynamic properties as a fiber and having an improved adhesiveness to resins can be obtained.

As the electrolyte used for the electrolytic oxidation, nitric acid, sulfuric acid, ammonium sulfate and sodium hydrogen carbonate can be exemplified. The electrolyte concentration of the electrolyte is preferably 0.1 N or more, further preferably 0.1 to 1 N.

<Sizing Treatment>

The carbon fiber bundle obtained by this way is subjected to a sizing treatment. The sizing treatment is carried out by using a sizing solution, preferably by using an aqueous dispersion of the sizing agent.

The concentration of the sizing agent in the sizing solution is preferably 0.1 to 25% by weight. As the method for applying the sizing solution to the carbon fiber bundle, a known method such as a roller sizing process, a roller immersion process, and a spray process can be used. Among these, the roller immersion process is preferable since the sizing solution is easily adhered homogeneously also to a carbon fiber bundle with a large number of filaments per one bundle of the carbon fiber bundle.

The liquid temperature of the sizing solution is preferably 10 to 50° C. to suppress the variation of the concentration of the sizing agent due to the evaporation of the solvent. Incidentally, the adhesion amount of the sizing agent can be adjusted by squeezing the excess sizing solution out after the sizing solution has been imparted.

The adhesion amount of the sizing agent is preferably 0.1% by weight to 10% by weight, further preferably 0.2% by weight to 5% by weight with respect to the weight of the carbon fiber with an adhered sizing agent. Since the adhesion amount of the sizing agent is in this range, homogeneous sizing on the fiber surface is made easy, and an appropriate convergence propriety property can be imparted in handling.

<Drying Treatment>

By subjecting the carbon fiber bundle after the sizing treatment to a drying treatment, a carbon fiber bundle with an adhered sizing agent can be obtained. In this drying treatment, the water, etc. used as the dispersion medium for the sizing solution is allowed to transpire.

For the drying treatment, an air drier is preferably used. The temperature of the drying treatment is generally 100 to 180° C. in the cases where the sizing solution is an aqueous dispersion. After the drying treatment, a heat treatment at a temperature of 200° C. or more may further be carried out.

In the drying treatment, the carbon fiber bundle after the sizing treatment is subjected to temperature rising, preferably at a temperature rise rate of 2.0° C./sec or more, further preferably at a temperature rise rate of 4.0° C./sec or more, from room temperature to 100° C. The upper limit of the temperature rise rate is preferably 100° C./sec. In the drying treatment, after the water is removed, it is preferable to retain the carbon fiber bundle with an adhered sizing agent at a temperature of 100° C. or more for 60 sec or more. By retaining the carbon fiber bundle with an adhered sizing agent under these conditions, the sizing agent is sufficiently softened and homogeneously spread by wetting on the carbon fiber, and the convergence propriety property of the carbon fiber is improved. The upper limit of the retention time is, for example, 500 sec, preferably 300 sec.

EXAMPLES

The present invention will further be explained below in detail by Examples. The evaluation was conducted by the following methods.

(1) Measurement of Viscoelasticity (Tan δ and Intersection Between Storage Modulus and Loss Modulus)

Using Discovery HR-2 manufactured by TA Instruments, a sizing agent composition was put on a 8 mm parallel plate, and viscoelasticity measurements at respective temperatures of −40° C., −30° C., −20° C., −10° C., 0° C., 10° C., 20° C., 25° C. and 40° C. were carried out at a distortion of 0.1%, and a frequency in the range from 0.01 Hz to 10 Hz. A master curve at 25° C. was prepared from the obtained data, and Tan δ was obtained. Furthermore, an intersection of a storage modulus and a loss modulus was read from the obtained graph. In Tables, the "intersection of a storage modulus and a loss modulus" is abbreviated as "Intersection".

(2) Water Solubility Rate

Ten grams of a sample was added to 90 g of water at 23° C., and the mixture was stirred for 30 minutes and subjected to liquid separation, and a water solubility rate was calculated by the following formula from the weight of an epoxy component obtained by the liquid separation. The mixture that yielded white turbidity after the stirring and thus was difficult to be separated was evaluated as "insoluble".

Water solubility rate (%)=weight of epoxy resin after liquid separation/weight of charged epoxy resin×100

(3) MPF

The carbon fiber bundle with an adhered sizing agent was travelled through five pin guides at a velocity of 50 feet/min for 2 min while applying a tension of 200 g, then passed through urethane sheets with a weight of 125 g put thereon, and the amount of carbon fibers collected on an urethane foam (amount of collected piles) was measured, and then calculated by the following formula.

MPF value (μg/ft)=amount of collected piles (μg)/evaluated fiber bundle length (ft)

(4) Convergence Propriety Property

The carbon fiber bundle with an adhered sizing agent was cut so as to have a length of 10 mm, and the state of the fiber bundle after the cutting was observed and evaluated by the following three ranks.

A: Unified (one bundle)

B: Split into two or three bundles

C: Split into 4 or more bundles (5) Widening Property

The carbon fiber bundle was brought into contact with three bars each having a surface roughness Ra of 2.0 μm so that the total of the contact angles with the respective bars becomes 180° with a tension of 1 kg, and travelled at a velocity of 5 m/min. The width of the carbon fiber bundle having passed the final bar was measured, and an widening property was calculated by the following formula and evaluated by the following three ranks.

widening property=yarn width after passing bar/initial yarn width×100

A: 150% or more

B: 120% or more and less than 150%

C: less than 120%

The materials used as the components for the sizing liquids in Examples and Comparative Examples are as follows.

<Aromatic Epoxy Resins> jER828: jER828 (product name) (manufactured by Mitsubishi Chemical Corporation: a bisphenol A-type epoxy resin, molecular weight: 370)

jER1001: jER1001 (product name) (manufactured by Mitsubishi Chemical Corporation: a bisphenol A-type epoxy resin, molecular weight: 900)

EM-160: Denacol EM-160 (product name) (manufactured by Nagase ChemteX Corporation: a cresol novolac-type epoxy emulsion, molecular weight: 2,600)

N-740: EPICLON N-740 (product name) (manufactured by DIC Corporation: phenol novolac)

<Aliphatic Epoxy Resin>

EX-931: Denacol EX-931 (product name) (manufactured by Nagase ChemteX Corporation: a polypropylene glycol diglycidyl ether, hydrocarbon group: methyl group, epoxy value: 2, epoxy equivalent amount: 471, water solubility rate: insoluble)

<Emulsifier>

U-103: Epan U-103 (product name) (manufactured by DKS Co. Ltd.: a polyoxyethylene-polyoxypropylene block polymer)

<Thermoplastic Resin>

P-2030: P-2030 (product name) (manufactured by Kuraray: an isophthalic acid-type polyester polyol, molecular weight: 2,000, complex viscosity at 25° C., 1 Hz: 15647 Pa·s)

P-2011: P-2011 (product name) (manufactured by Kuraray Co., Ltd.: a terephthalic acid and adipic acid-type polyester polyol, molecular weight: 2,000, complex viscosity at 25° C., 1 Hz: 57 Pa·s)

C-2090: P-2090 (product name) (manufactured by Kuraray Co., Ltd.: a polycarbonate polyol, molecular weight: 2,000 complex viscosity at 25° C., 1 Hz: 33 Pa·s)

Teslac 2461: Teslac 2461 (product name) (manufactured by Hitachi Chemical Co., Ltd.: an adipic acid-based polyester polyol, molecular weight: 2,000, complex viscosity at 25° C., 1 Hz: 499931 Pa·s)

PH-300: UBE ETERNACOLL PH-300 (product name) (Ube Industries, Ltd.: an aliphatic polyester polyol, molecular weight: 3,000, complex viscosity at 25° C., 1 Hz: 361 Pa·s

Example 1

<Preparation of Aqueous Dispersion of Sizing Agent>

An aqueous dispersion emulsion including 30 parts by weight of EX-931, 30 parts by weight of EM-160, 30 parts by weight of P-2030, and 10 parts by weight of U-103 as an emulsifier was prepared to give an aqueous dispersion of a sizing agent. This was used as a sizing solution.

<Manufacture of Carbon Fiber Bundle with Adhered Sizing Agent>

The polyacrylonitrile fiber was subjected to an oxidation treatment in the air at 250° C., and then subjected to low temperature carbonization under a nitrogen gas atmosphere at the highest temperature of 650° C. The product was then subjected to high temperature carbonization under a nitrogen atmosphere at 1,300° C. to manufacture a carbon fiber, and the carbon fiber was then subjected to a surface treatment by using 10% by weight of an aqueous ammonium sulfate solution by electrolytic oxidation to give an unsized carbon fiber bundle (tensile strength: 5,100 MPa, tensile modulus: 245 GPa, single fiber diameter: 7.0 μm, number of filaments: 24,000).

Next, the obtained unsized carbon fiber bundle was continuously immersed in a bath of the sizing solution to allow the sizing solution to permeate into the filaments in the fiber bundle. The carbon fiber bundle after the immersion was dried by using a vertical flow type hot air drier by raising the temperature from room temperature to 100° C. at a velocity of 4.38° C./sec and further retaining at 100° C. or more for 72 seconds to give a carbon fiber bundle with an adhered sizing agent. The evaluation results are shown in Table 1.

Example 2

<Preparation of Aqueous Dispersion of Sizing Agent>

An aqueous dispersion emulsion including 45 parts by weight of EM-160, 45 parts by weight of PH-300, and 10 parts by weight of U-103 as an emulsifier was prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Example 1, except that the sizing solution was changed to the above one. The evaluation results are shown in Table 1.

Example 3

<Preparation of Aqueous Dispersion of Sizing Agent>

An aqueous dispersion emulsion including 67 parts by weight of jER828, 23 parts by weight of P-2030, and 10 parts by weight of U-103 as an emulsifier was prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Example 1, except that the sizing solution was changed to the above one. The evaluation results are shown in Table 1.

Example 4

<Preparation of Aqueous Dispersion of Sizing Agent>

An aqueous dispersion emulsion including 36 parts by weight of EX-931, 29 parts by weight of N-740, 25 parts by weight of Teslac 2461, and 10 parts by weight of U-103 as an emulsifier were prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Example 1, except that the sizing solution was changed to the above one. The evaluation results are shown in Table 1.

Example 5

<Preparation of Aqueous Dispersion of Sizing Agent>

An aqueous dispersion emulsion including 36 parts by weight of EX-931, 24 parts by weight of N-740, 30 parts by weight of Teslac 2461, and 10 parts by weight of U-103 as an emulsifier was prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Example 1, except that the sizing solution was changed to the above one. The evaluation results are shown in Table 1.

TABLE 1

| | | | Molecular weight | 25° C. 1 Hz Composite viscosity (Pa · s) | 25° C. 1 Hz Storage viscosity (Pa) | Example 1 |
|---|---|---|---|---|---|---|
| Aliphatic epoxy | EX-931 | | — | | | 30 parts by weight |
| Aromatic epoxy | jER828 | | — | | | |
| | jER1001 | | — | | | |
| | EM-160 | | — | | | 30 parts by weight |
| | N-740 | | — | | | |
| Polyester | P2030 | Isophthalic acid type polyester polyol | 2000 | 15647 | 15014 | 30 parts by weight |
| | PH300 | Aliphatic polyester polyol | 3000 | 361 | 77 | |
| | Teslac 2461 | Adipic acid type polyester polyol | 2000 | 499931 | 267920 | |
| | P2011 | Terephthalic acid and adipic acid type polyester polyol | 2000 | 56.9 | 47.6 | |
| | C-2090 | Polycarbonate polyol | 2000 | 33 | 57.17 | |
| Emulsifier | U-103 | | | | | 10 parts by weight |
| Intersection | rad/sec | | | | | $1.1 \times 10^6$ |
| Tanδ | 1 rad/sec | | | | | 1.35 |
| | $1 \times 10^3$ rad/sec | | | | | 5.09 |
| | $1 \times 10^5$ rad/sec | | | | | 1.33 |
| Convergence propriety property | | | | | | A |
| Opening property | | | | | | A |
| MPF | | | | | | 27 |

| | | | Example 2 | Example 3 | Example 4 | Example 5 |
|---|---|---|---|---|---|---|
| Aliphatic epoxy | EX-931 | | | | 36 parts by weight | 36 parts by weight |
| Aromatic epoxy | jER828 | | | 67 parts by weight | | |
| | jER1001 | | | | | |
| | EM-160 | | 45 parts by weight | | | |
| | N-740 | | | | 29 parts by weight | 24 parts by weight |
| Polyester | P2030 | Isophthalic acid type polyester polyol | | 23 parts by weight | | |
| | PH300 | Aliphatic polyester polyol | 45 parts by weight | | | |
| | Teslac 2461 | Adipic acid type polyester polyol | | | 25 parts by weight | 30 parts by weight |
| | P2011 | Terephthalic acid and adipic acid type polyester polyol | | | | |
| | C-2090 | Polycarbonate polyol | | | | |
| Emulsifier | U-103 | | 10 parts by weight | 10 parts by weight | 10 parts by weight | 10 parts by weight |
| Intersection | rad/sec | | $2.3 \times 10^7$ | $4.6 \times 10^5$ | $1.2 \times 10^6$ | $3.2 \times 10^5$ |
| Tanδ | 1 rad/sec | | 3.8 | 1.51 | 1.09 | 0.76 |
| | $1 \times 10^3$ rad/sec | | 1.16 | 10.48 | 5.03 | 4.38 |
| | $1 \times 10^5$ rad/sec | | 1.11 | 12.06 | 1 | 0.85 |
| Convergence propriety property | | | A | A | A | A |
| Opening property | | | A | A | A | B |
| MPF | | | 31 | 34 | 30 | 43 |

Comparative Example 1

<Preparation of Aqueous Dispersion of Sizing Agent>

An aqueous dispersion emulsion including 45 parts by weight of EX-931, 20 parts by weight of jER828, 25 parts by weight of jER1001, and 10 parts by weight of U-103 as an emulsifier was prepared, and used as an aqueous dispersion of the sizing agent.

<Manufacture of Carbon Fiber Bundle with Adhered Sizing Agent>

A fiber bundle with an adhered sizing agent was obtained in a similar manner to that of Example 1, except that the sizing solution was changed to the above one. The evaluation results are shown in Table 2.

Comparative Example 2

<Preparation of Aqueous Dispersion of Sizing Agent>

An aqueous dispersion emulsion including 63 parts by weight of EX-931, 27 parts by weight of P-2030, and 10 parts by weight of U-103 as an emulsifier was prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Example 1, except that the sizing solution was changed to the above one. The evaluation results are shown in Table 2.

Comparative Example 3

<Preparation of Aqueous Dispersion of Sizing Agent>

An aqueous dispersion emulsion including 60 parts by weight of EM-160, 30 parts by weight of PH-300, and 10 parts by weight of U-103 as an emulsifier was prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Example 1, except that the sizing solution was changed to the above one. The evaluation results are shown in Table 2.

Comparative Example 4

<Preparation of Aqueous Dispersion of Sizing Agent>

An aqueous dispersion emulsion including 30 parts by weight of EX-931, 30 parts by weight of EM-160, 30 parts by weight of P-2011, and 10 parts by weight of U-103 as an emulsifier were prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Comparative Example 1, except that the sizing solution was changed to the above one. The evaluation results are shown in Table 2.

Comparative Example 5

<Preparation of Aqueous Dispersion of Sizing Agent>

An aqueous dispersion emulsion including 30 parts by weight of EX-931, 30 parts by weight of EM-160, 30 parts by weight of C-2090, and 10 parts by weight of U-103 as an emulsifier was prepared, and used as an aqueous dispersion of the sizing agent.

<Manufacture of Carbon Fiber Bundle with Adhered Sizing Agent>

A carbon fiber bundle with an adhered sizing agent was obtained in a similar manner to that of Comparative Example 1, except that the sizing solution was changed to the above one. The evaluation results are shown in Table 2.

TABLE 2

| | | | Molecular weight | 25° C. 1 Hz Composite viscosity (Pa · s) | 25° C. 1 Hz Storage viscosity (Pa) | Comparative Example 1 |
|---|---|---|---|---|---|---|
| Aliphatic epoxy | EX-931 | | — | | | 45 parts by weight |
| Aromatic epoxy | jER828 | | — | | | 20 parts by weight |
| | jER1001 | | — | | | 25 parts by weight |
| | EM-160 | | — | | | |
| | N-740 | | — | | | |
| Polyester | P2030 | Isophthalic acid type polyester polyol | 2000 | 15647 | 15014 | |
| | PH300 | Aliphatic polyester polyol | 3000 | 361 | 77 | |
| | Teslac 2461 | Adipic acid type polyester polyol | 2000 | 499931 | 267920 | |
| | P2011 | Terephthalic acid and adipic acid type polyester polyol | 2000 | 56.9 | 47.6 | |
| | C-2090 | Polycarbonate polyol | 2000 | 33 | 57.17 | |
| Emulsifier | U-103 | | | | | 10 parts by weight |
| Intersection | rad/sec | | | | | $4.58 \times 10^9$ |
| Tanδ | 1 rad/sec | | | | | 1.08 |
| | $1 \times 10^3$ rad/sec | | | | | 0.89 |
| | $1 \times 10^5$ rad/sec | | | | | 0.45 |
| Convergence property | propriety | | | | | C |
| Opening property | | | | | | A |
| MPF | | | | | | 45 |

| | | | Comparative Example 2 | Comparative Example 3 | Comparative Example 4 | Comparative Example 5 |
|---|---|---|---|---|---|---|
| Aliphatic epoxy | EX-931 | | 63 parts by weight | | 30 parts by weight | 30 parts by weight |
| Aromatic epoxy | jER828 | | | | | |
| | jER1001 | | | | | |
| | EM-160 | | | 60 parts by weight | 30 parts by weight | 30 parts by weight |
| | N-740 | | | | | |
| Polyester | P2030 | Isophthalic acid type polyester polyol | 27 parts by weight | | | |
| | PH300 | Aliphatic polyester polyol | | 30 parts by weight | | |
| | Teslac 2461 | Adipic acid type polyester polyol | | | | |

TABLE 2-continued

| | | | | | | |
|---|---|---|---|---|---|---|
| | P2011 | Terephthalic acid and adipic acid type polyester polyol | | | 30 parts by weight | |
| | C-2090 | Polycarbonate polyol | | | | 30 parts by weight |
| Emulsifier | U-103 | | 10 parts by weight | 10 parts by weight | 10 parts by weight | 10 parts by weight |
| Intersection | rad/sec | | $5.0 \times 10^{12}$ | $3.7 \times 10^{2}$ | $4.8 \times 10^{12}$ | $4.5 \times 10^{12}$ |
| Tanδ | 1 rad/sec | | 1.49 | 6.29 | 1.58 | 3.56 |
| | $1 \times 10^{3}$ rad/sec | | 9.98 | 0.94 | 0.96 | 1.16 |
| | $1 \times 10^{5}$ rad/sec | | 5.9 | 0.65 | 0.87 | 0.91 |
| Convergence propriety property | | | C | A | C | C |
| Opening property | | | A | C | A | A |
| MPF | | | 37 | 50 | 48 | 52 |

All of the carbon fiber bundles with an adhered sizing agent obtained in Examples 1 to 3 had fine qualities, and showed an excellent abrasion property.

INDUSTRIAL APPLICABILITY

The carbon fiber bundle with an adhered sizing agent of the present invention is a carbon fiber bundle having an excellent abrasion property, and thus a high performance composite material that is excellent in high-order processability and also excellent in compatibility and adhesiveness with a matrix resin can be obtained. The obtained composite material can be utilized in the fields of sports, general industries, aviation and space, automobiles, etc.

The invention claimed is:

1. A carbon fiber bundle with an adhered sizing agent comprising:

a carbon fiber, and a sizing agent adhered to a surface of the carbon fiber, wherein the sizing agent contains an epoxy compound, and shows an intersection of a storage modulus and a loss modulus at an angular frequency in the range of $1\times10^{5}$ to $1\times10^{9}$ rad/sec in a measurement at 25° C.

2. The carbon fiber bundle with an adhered sizing agent according to claim 1, wherein the sizing agent has Tan δ at 25° C. of 1 or more in an entire range of an angular frequency of 1 to $1\times10^{5}$ rad/sec.

3. The carbon fiber bundle with an adhered sizing agent according to claim 1, wherein the sizing agent further contains a thermoplastic resin, and the thermoplastic resin has a complex viscosity at 25° C. 1 Hz of 100 Pa·s or more.

4. The carbon fiber bundle with an adhered sizing agent according to claim 1, wherein the sizing agent further contains a polyoxyalkylene-based compound as an emulsifier.

5. The carbon fiber bundle with an adhered sizing agent according to claim 4, wherein the content of the polyoxyalkylene-based compound in the sizing agent is 1 to 50% by weight per 100% by weight of a total weight of the epoxy compound and the polyoxyalkylene-based compound.

6. The carbon fiber bundle with an adhered sizing agent according to claim 2, wherein the sizing agent further contains a thermoplastic resin, and the thermoplastic resin has a complex viscosity at 25° C. 1 Hz of 100 Pa·s or more.

7. The carbon fiber bundle with an adhered sizing agent according to claim 2, wherein the sizing agent further contains a polyoxyalkylene-based compound as an emulsifier.

8. The carbon fiber bundle with an adhered sizing agent according to claim 3, wherein the sizing agent further contains a polyoxyalkylene-based compound as an emulsifier.

9. The carbon fiber bundle with an adhered sizing agent according to claim 6, wherein the sizing agent further contains a polyoxyalkylene-based compound as an emulsifier.

10. The carbon fiber bundle with an adhered sizing agent according to claim 7, wherein the content of the polyoxyalkylene-based compound in the sizing agent is 1 to 50% by weight per 100% by weight of a total weight of the epoxy compound and the polyoxyalkylene-based compound.

11. The carbon fiber bundle with an adhered sizing agent according to claim 8, wherein the content of the polyoxyalkylene-based compound in the sizing agent is 1 to 50% by weight per 100% by weight of a total weight of the epoxy compound and the polyoxyalkylene-based compound.

12. The carbon fiber bundle with an adhered sizing agent according to claim 9, wherein the content of the polyoxyalkylene-based compound in the sizing agent is 1 to 50% by weight per 100% by weight of a total weight of the epoxy compound and the polyoxyalkylene-based compound.

* * * * *